US006255570B1

(12) United States Patent
Liao

(10) Patent No.: US 6,255,570 B1
(45) Date of Patent: Jul. 3, 2001

(54) VESSEL-SHAPED FLUTE WITH A CAPTIVE CAP

(76) Inventor: Chih-Wen Liao, No. 87-1, Ssu-Wei 3 Rd., Ling-Ya Dist., Kaohsiung (TW)

( * ) Notice: Subject to any disclaimer, the term of this patent is extended or adjusted under 35 U.S.C. 154(b) by 0 days.

(21) Appl. No.: 09/754,719

(22) Filed: Jan. 4, 2001

(51) Int. Cl.[7] ..... G10D 7/02
(52) U.S. Cl. ..... 84/384; 84/379; D17/13
(58) Field of Search ..... 84/384, 352, 385 A, 84/380 B, 387 A; 446/71–81, 206, 216; D17/13; D99/43

(56) References Cited

U.S. PATENT DOCUMENTS

D. 86,705 * 4/1932 Dopyera ..... D17/13
2,331,975 * 10/1943 Hagoppian ..... 84/330
2,460,931 * 12/1949 Gretsch ..... 84/380
2,485,749 * 10/1949 Ladd ..... 84/384
3,767,506 * 10/1973 Kawakami ..... 156/293
3,815,466 * 6/1974 Johnson ..... 84/380

* cited by examiner

*Primary Examiner*—Robert E. Nappi
*Assistant Examiner*—Kim Lockett
(74) *Attorney, Agent, or Firm*—Jackson Walker L.L.P.

(57) ABSTRACT

A vessel-shaped flute has a body and a captive cap. The cap is pivotally attached to the body with a pivot pin. A through hole is defined through the pivot pin. Consequently, the cap can cover the mouthpiece and all of the finger holes when the vessel-shaped flute is not in use. Protection is provided to the mouthpiece and finger holes to prevent them from being damaged or getting dirty. In addition, a cord can be threaded through the through hole. The user can wear the vessel-shaped flute as a necklace. The use and the decorative effect of the vessel-shaped flute are improved.

15 Claims, 6 Drawing Sheets

VESSEL-SHAPED FLUTE WITH A CAPTIVE CAP

BACKGROUND OF THE INVENTION

1. Field of the Invention

The present invention relates to a vessel-shaped flute, and more particularly to a vessel-shaped flute with a captive cap to protect the mouthpiece and finger holes of the flute.

2. Description of Related Art

The vessel-shaped flute is a popular musical instrument. The conventional vessel-shaped flute comprises a hollow body, a mouthpiece and several finger holes. The mouthpiece is defined in the periphery of the body. The finger holes are defined in the top of the body. In use, the user blows the mouthpiece with his or her mouth and covers the finger holes with the tips of his or her fingers. The sound generated in the mouthpiece by the user's breath will resonate in the hollow body to form a more pleasing sound.

However, the mouthpiece and the finger holes of the conventional vessel-shaped flute are exposed when the flute is not being used. The mouthpiece and the finger holes are easily damaged as the vessel-shaped flute bumps other objects. In addition, dust easily gets the exposed mouthpiece and finger holes dirty. There is a sanitation problem when using the vessel-shaped flute with a dirty mouthpiece.

To overcome the shortcomings, the present invention provide a vessel-shaped flute with a captive cap to mitigate or obviate the aforementioned problems.

SUMMARY OF THE INVENTION

The main objective of the invention is to provide a vessel-shaped flute with a captive cap to cover the mouthpiece and all of the finger holes. The vessel-shaped flute has a hollow body and a cap. The cap is pivotally attached to the body. This protects the mouthpiece and finger holes to prevent them from being damaged or getting dirty.

The secondary objective of the invention is to provide a vessel-shaped flute with a cap pivotally attached to the body with a hollow pivot pin so a cord can be threaded through the through hole. Consequently, the user can wear the vessel-shaped flute as a necklace or hang it Up as a decoration. The use and the decoration of the vessel-shaped flute are improved.

Other objects, advantages and novel features of the invention will become more apparent from the following detailed description when taken in conjunction with the accompanying drawings.

DETAILED DESCRIPTION OF PREFERRED EMBODIMENT

Figure 1:
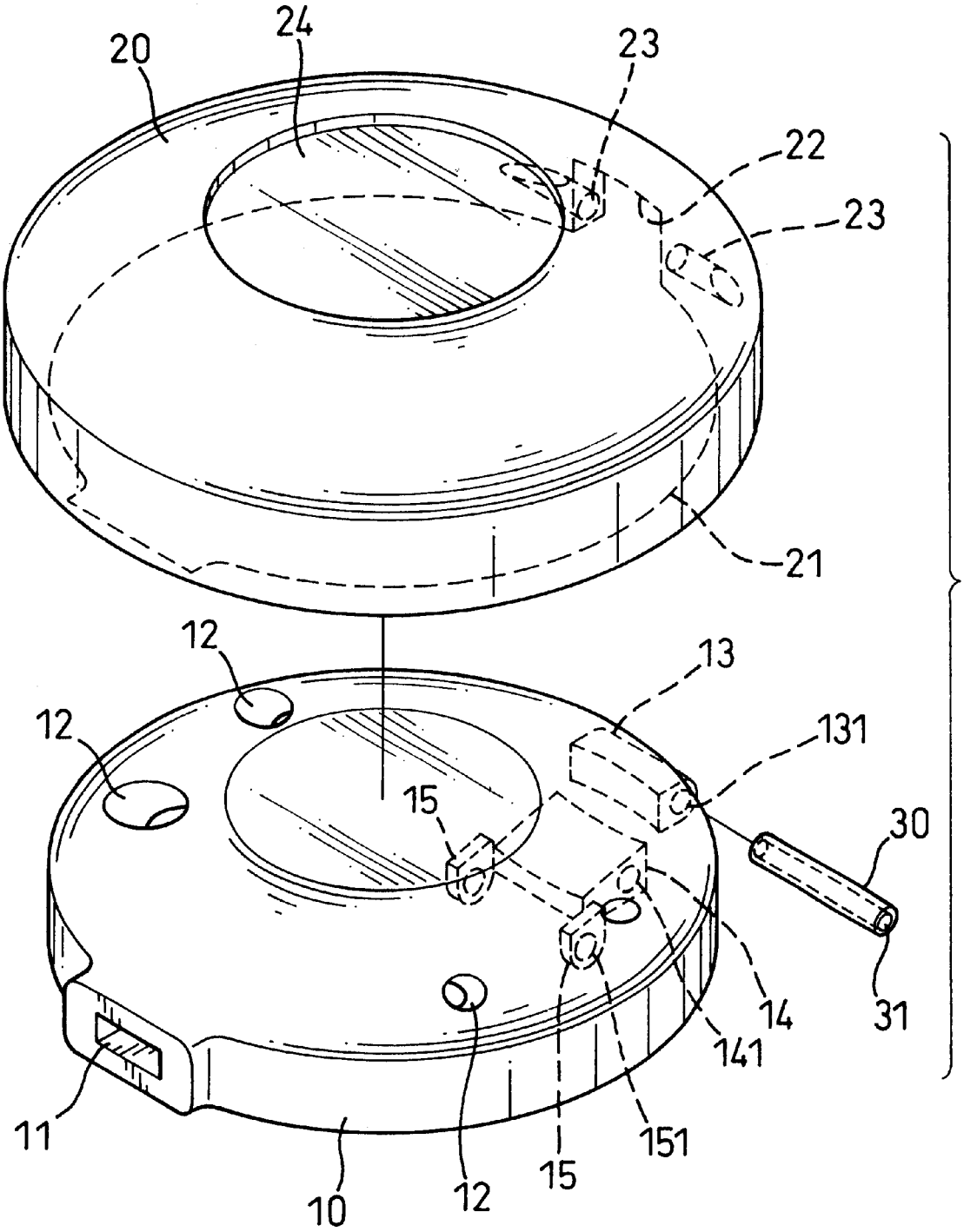
FIG. 1 is an exploded perspective view of a vessel-shaped flute in accordance with the present invention.
Figure 2:
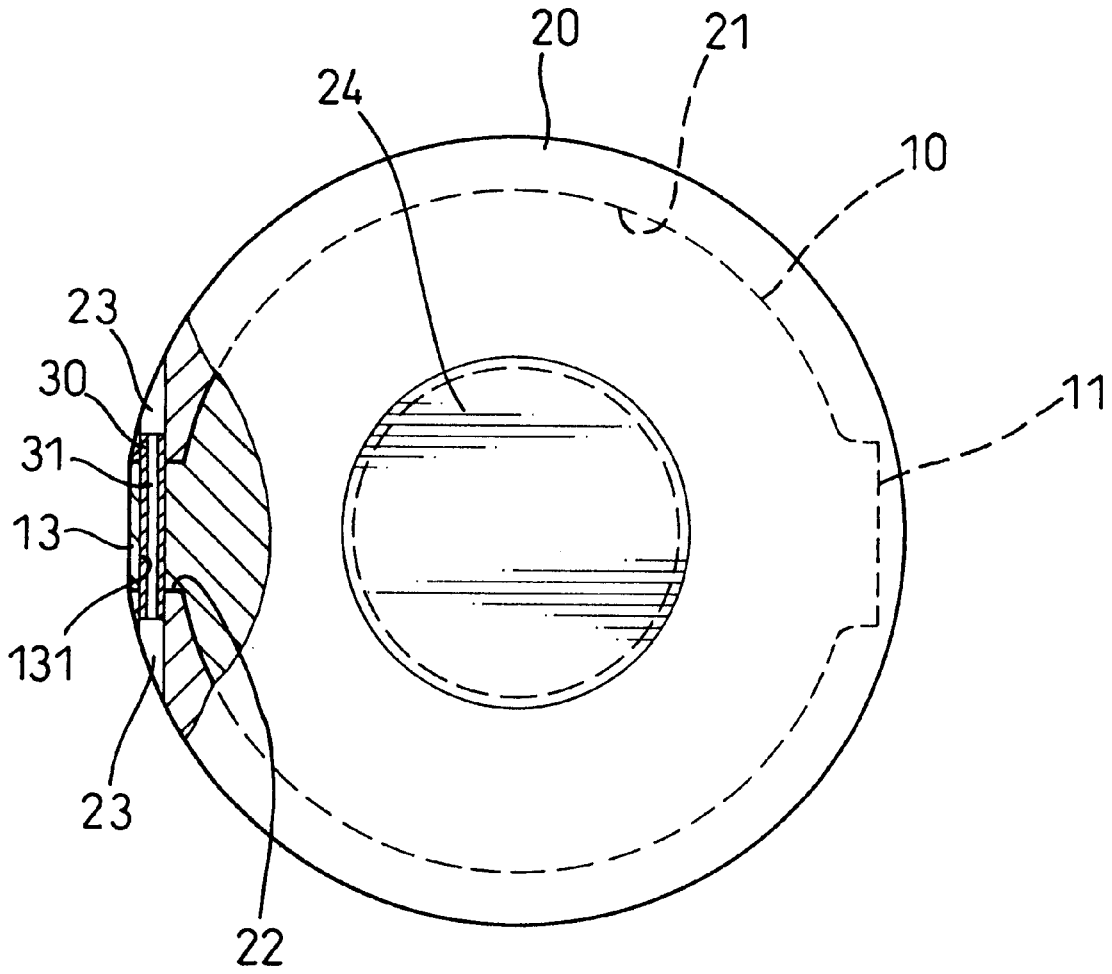
FIG. 2 is a top plan view in partial section of the vessel-shaped flute in FIG. 1.
Figure 3:
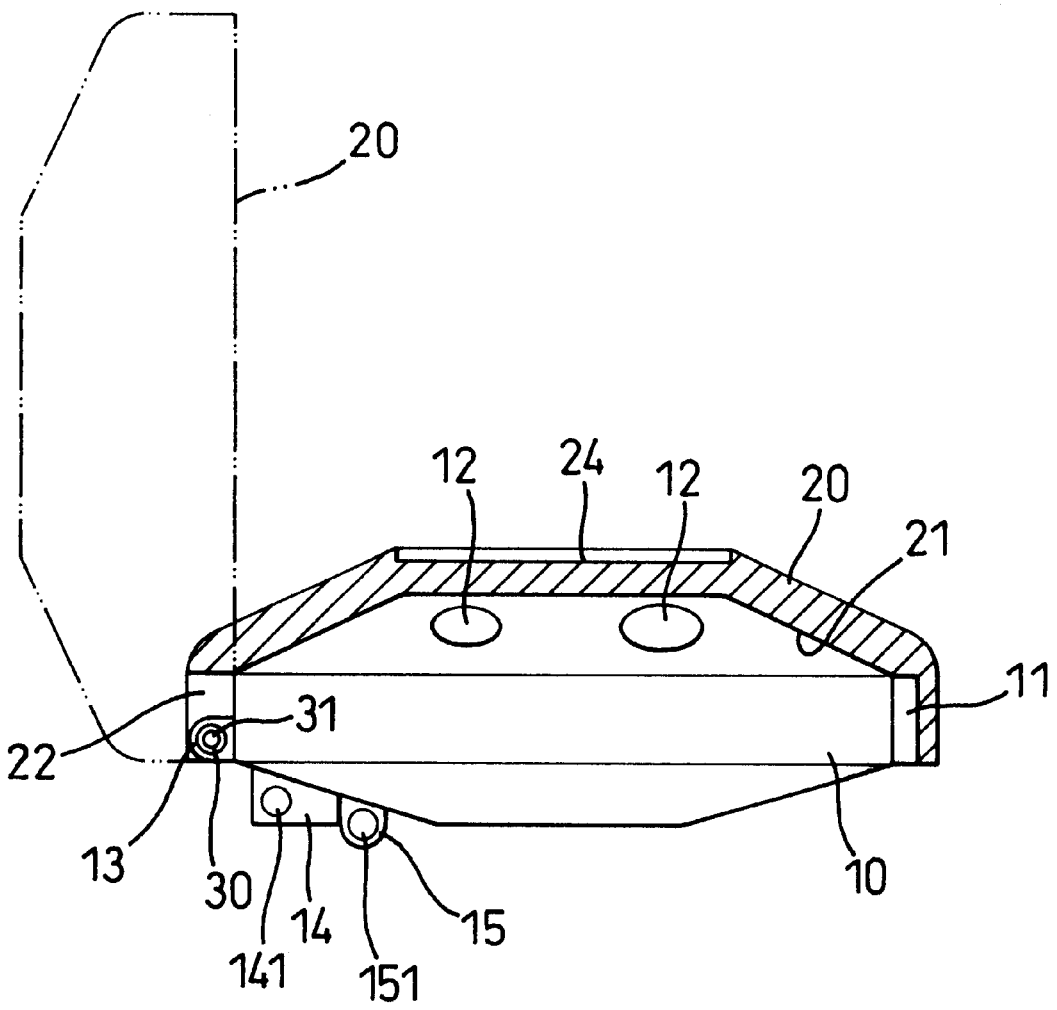
FIG. 3 is an operational side plan view in partial section of the vessel-shaped flute in FIG. 1.
Figure 4:
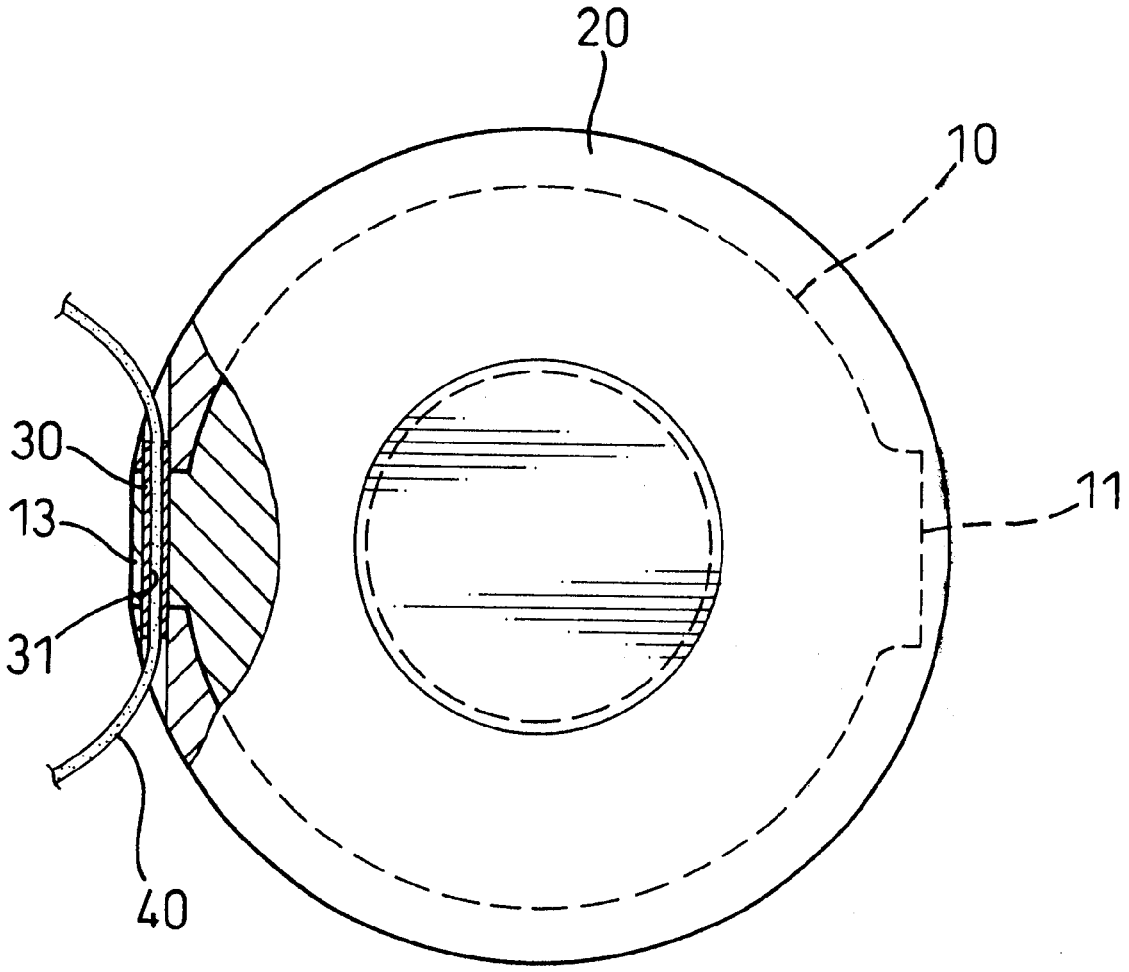
FIG. 4 is a top plan view in partial section of the vessel-shaped flute in FIG. 1 with a cord threaded through the through hole in the pivot pin.
Figure 5:
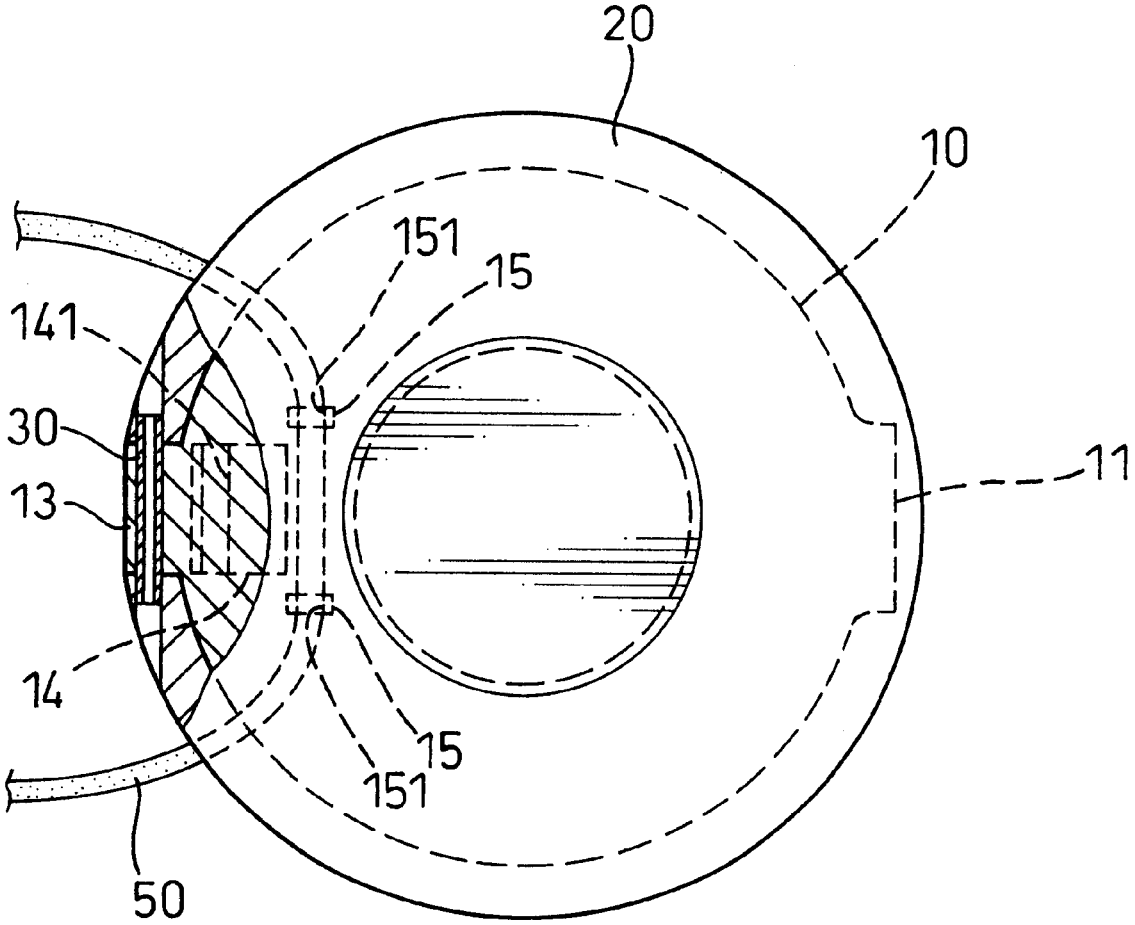
FIG. 5 is a top plan view in partial section of the vessel-shaped flute in FIG. 1 with a cord threaded through the through holes in the ears.
Figure 6:
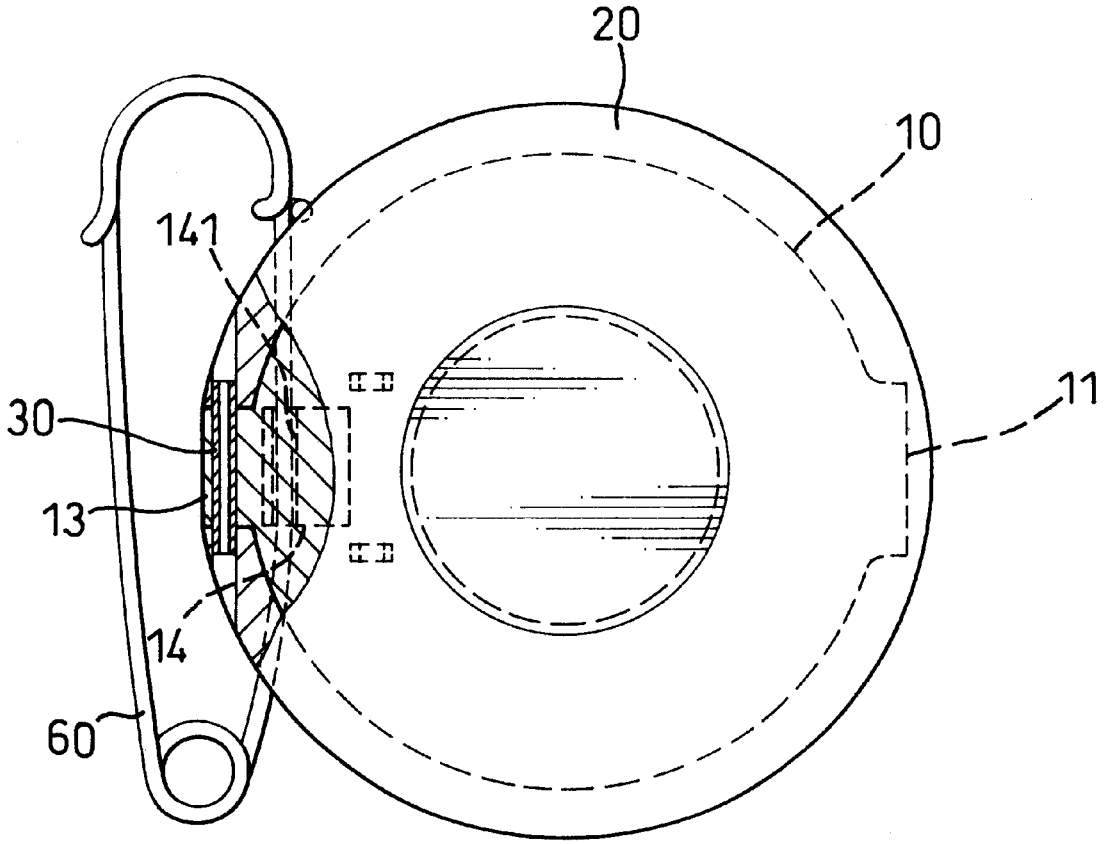
FIG. 6 is a top plan view in partial section of the vessel-shaped flute in FIG. 1 with a safety pin inserted through the through hole in the protrusion.

With reference to FIGS. 1 to 3, a vessel-shaped flute in accordance with the present invention comprises a hollow body (10) and a captive cap (20). The hollow body (10) has a mouthpiece (11) and multiple finger holes (12). The mouthpiece (11) is defined in the periphery of the body (10). The finger holes (12) are defined in the top of the body (10). The cap (20) is pivotally attached to the body (10). A cavity (21) is defined in the bottom of the cap (20) to receive the body (10). Consequently, the cap (20) can cover the mouthpiece (11) and all of the finger holes (12). In practice, a hinge block (13) is formed on the periphery of the body (10) at a position opposite to the mouthpiece (11). A first through hole (131) is defined through the block (13). A recess (22) is defined in the cap (20) to receive the block (13) on the body (10). A second through hole (23) is defined through the cap (20) and aligns with the first through hole (131) in the block (13). A pivot pin (30) extends through the first and second through holes (131,23) in the block (13) and the cap (20) to pivotally attach the cap (20) to the body (10) with the pivot pin (30).

Accordingly, the cap (20) covers the mouthpiece (11) and all of the finger holes (20) when the vessel-shaped flute is not in use. The cap (20) can protect the mouthpiece (1) and finger holes (12) and prevent them from being damaged and getting dirty.

With reference to FIGS. 1 to 4, a third through hole (31) is defined through the pivot pin (30). A cord (40) can be threaded through the third through hole (31). Consequently, the user can hang the vessel-shaped flute by the cord (40) as an ornament. The use of the vessel-shaped flute is improved. In addition, a depression (24) is defined in the top of the cap (20). A mark or a figure can be mounted in the depression (24). Consequently, the decoration of the vessel-shaped flute is further improved.

With reference to FIGS. 1, 3, 5 and 6, a protrusion (14) is defined in the bottom of the body (10). A fourth through hole (141) is defined through the protrusion (14). A safety pin (60) can be inserted through the fourth through hole (141), such that the vessel-shaped flute is used as a brooch. In addition, two ears (15) are formed on the bottom of the body (10) parallel to each other. A fifth through hole (151) is defined in each ear (15) and aligns with the through hole (151) in the other ear (151). A cord (50) can be threaded through the fifth through holes (151). Consequently, the users can wear the vessel-shaped flute like a necklace. The scope of using the vessel-shaped flute is enlarged.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A vessel-shaped flute comprising:

a hollow body;

a mouthpiece defined in the body and communicating with the body;

multiple finger holes defined in a top of the body and each communicating with the body; and a cap pivotally attached to the body with a pivot pin to cover the mouthpiece and all of the finger holes.

2. The vessel-shaped flute claimed in claim 1, wherein a hinge block is integrally formed on the periphery of the body at a position opposite to the mouthpiece, a first through hole is defined through the hinge block;

a second through hole is defined in the cap and aligns with the first through hole in the hinge block; and the pivoting pin extends through the first through hole in the hinge block and the second through hole in the cap to pivotally attach the cap to the body.

3. The vessel-shaped flute claimed in claim 2, wherein a recess is defined in the cap to receive the hinge block on the body.

4. The vessel-shaped flute claimed in claim 2, wherein a third through hole is defined through the pivoting pin to have a cord threaded through the third through hole.

5. The vessel-shaped flute claimed in claim 1, wherein a protrusion is formed on a bottom of the body; and a fourth through hole is defined through the protrusion to attach a safety pin through the fourth through hole.

6. The vessel-shaped flute claimed in claim 1, wherein two ears are formed on a bottom of the body parallel with each other; and a fifth through hole is defined in each ear and aligns with the through hole defined in the other ear to have a cord threaded through the fifth through holes.

7. The vessel-shaped flute claimed in claim 1, wherein a depression is defined in a top of the cap to receive a mark in the depression.

8. The vessel-shaped flute claimed in claim 3, wherein a third through hole is defined through the pivoting pin to have a cord threaded through the third through hole.

9. The vessel-shaped flute claimed in claim 2, wherein a protrusion is formed on a bottom of the body; and a fourth through hole is defined through the protrusion to attach a safety pin through the fourth through hole.

10. The vessel-shaped flute claimed in claim 3, wherein a protrusion is formed on a bottom of the body; and a fourth through hole is defined through the protrusion to attach a safety pin through the fourth through hole.

11. The vessel-shaped flute claimed in claim 4, wherein a protrusion is formed on a bottom of the body; and a fourth through hole is defined through the protrusion to attach a safety pin through the fourth through hole.

12. The vessel-shaped flute claimed in claim 2, wherein two ears are formed on a bottom of the body parallel with each other; and a fifth through hole is defined in each ear and aligns with the through hole defined in the other ear to have a cord threaded through the fifth through holes.

13. The vessel-shaped flute claimed in claim 3, wherein two ears are formed on a bottom of the body parallel with each other; and a fifth through hole is defined in each ear and aligns with the through hole defined in the other ear to have a cord threaded through the fifth through holes.

14. The vessel-shaped flute claimed in claim 4, wherein two ears are formed on a bottom of the body parallel with each other; and a fifth through hole is defined in each ear and aligns with the through hole defined in the other ear to have a cord threaded through the fifth through holes.

15. The vessel-shaped flute claimed in claim 5, wherein two cars are formed on a bottom of the body parallel with each other; and a fifth through hole is defined in each ear and aligns with the through hole defined in the other ear to have a cord threaded through the fifth through holes.

* * * * *